US010989002B2

(12) United States Patent
Ross et al.

(10) Patent No.: US 10,989,002 B2
(45) Date of Patent: Apr. 27, 2021

(54) CABLE PACK-OFF APPARATUS FOR WELL HAVING ELECTRICAL SUBMERSIBLE PUMP

(71) Applicant: INNOVEX DOWNHOLE SOLUTIONS, INC., Houston, TX (US)

(72) Inventors: Stephen C. Ross, Odessa, TX (US); Orlando J. Hinds, Odessa, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 429 days.

(21) Appl. No.: 15/982,341

(22) Filed: May 17, 2018

(65) Prior Publication Data

US 2019/0264519 A1 Aug. 29, 2019

Related U.S. Application Data

(60) Provisional application No. 62/635,425, filed on Feb. 26, 2018.

(51) Int. Cl.

| | |
|---|---|
| ***E21B 33/076*** | (2006.01) |
| ***E21B 23/14*** | (2006.01) |
| ***E21B 43/12*** | (2006.01) |
| ***E21B 43/08*** | (2006.01) |
| ***E21B 33/04*** | (2006.01) |

(52) U.S. Cl.

CPC ..... *E21B 23/14* (2013.01); *E21B 33/0407* (2013.01); *E21B 43/08* (2013.01); *E21B 43/128* (2013.01)

(58) Field of Classification Search

CPC ..... E21B 33/072; E21B 33/076

See application file for complete search history.

(56) References Cited

U.S. PATENT DOCUMENTS 3,394,761 A * 7/1968 Jackson, Jr. et al. ..... E21B 33/047 166/89.2

3,437,149 A 4/1969 Cugini et al.

(Continued)

OTHER PUBLICATIONS

Cooke, A. C. H., et al.; Review and Analysis of Equipment for Running Electrical Cables under Pressure; Journal of Petroleum Technology: Feature Article; Published Feb. 1, 1956; pp. 10-14; vol. 8, No. 2; Society of Petroleum Engineers; United Sates of America; Retrieved May 17, 2018, from URL: https://www.onepetro.org/journal-paper/SPE-528-G?sort=&start=0&q=SPE+S28-G&from_year=&peer_reviewed=&published_between=&fromSearchResults=true&to_year=&rows=25#.

(Continued)

*Primary Examiner* — Cathleen R Hutchins
*Assistant Examiner* — Ronald R Runyan
(74) *Attorney, Agent, or Firm* — MH2 Technology Law Group LLP

(57) ABSTRACT

A cable pack-off apparatus for a wellbore is provided. The apparatus is designed to threadedly connect to the auxiliary port of a tubing head, over the wellbore, and to receive a power cable. The power cable provides power to an ESP downhole. The cable pack-off apparatus provides a self-sealing mechanism in the event that the power cable must be pulled (or becomes pulled) from the wellbore, such as in the event of parted tubing. A packing element sealingly receives the power cable within a housing of the apparatus. A method for self-sealing a tubing head over a wellbore is also provided herein.

34 Claims, 19 Drawing Sheets

(56) References Cited

U.S. PATENT DOCUMENTS

| | | | | |
|---|---|---|---|---|
| 3,781,456 | A * | 12/1973 | Knowles | E21B 33/0407 174/23 R |
| 3,945,700 | A | 3/1976 | Didier | |
| 4,154,302 | A | 5/1979 | Cugini | |
| 4,289,199 | A | 9/1981 | McGee | |
| 4,365,506 | A * | 12/1982 | Hyde | E21B 17/003 219/507 |
| 4,491,176 | A | 1/1985 | Reed | |
| 4,583,804 | A | 4/1986 | Thompson | |
| 4,627,489 | A | 12/1986 | Reed | |
| 4,693,534 | A | 9/1987 | Clark | |
| 4,708,201 | A | 11/1987 | Reed | |
| 5,012,865 | A * | 5/1991 | McLeod | E21B 17/1007 166/90.1 |
| 5,732,771 | A | 3/1998 | Moore | |
| 6,015,009 | A | 1/2000 | Allen | |
| 6,200,152 | B1 | 3/2001 | Hopper | |
| 6,530,433 | B2 | 3/2003 | Smith et al. | |
| 6,688,386 | B2 | 2/2004 | Cornelssen et al. | |
| 6,736,208 | B2 | 5/2004 | Riddell et al. | |
| 7,314,085 | B2 | 1/2008 | Hopper et al. | |
| 7,730,968 | B2 | 6/2010 | Hosie et al. | |
| 9,376,883 | B2 | 6/2016 | Nguyen et al. | |
| 9,376,887 | B2 * | 6/2016 | Bernard | E21B 33/03 |
| 9,377,561 | B2 | 6/2016 | Rogers et al. | |
| 9,593,561 | B2 | 3/2017 | Xiao et al. | |
| 9,920,773 | B2 | 3/2018 | Wilson et al. | |

OTHER PUBLICATIONS

Caycedo, Luis, and Joe B. Diebold; An Artificial Lift System that Utilizes Cable Suspended Electrical Submergible Pumps; Published Jan. 1, 1979; Society of Petroleum Engineer; Las Vegas, Nevada; Retrieved May 17, 2018, from URL: https://www.onepetro.org/conference-paper/SPE-8242-MS?sort=&start=0&q=dc_creator%3A%28%22Caycedo%2C+Luis%22%29&fromSearchResults=true&rows=10#.

Godbunov, Dmitrii; Ultra-Slim Cable-Deployed ESP Systems for Oil Field Development and Production. Published circa 2017; Society of Petroleum Engineers; Moscow, Russia; Retrieved May 17, 2018, from URL: https://www.onepetro.org/conference-paper/SPE-187733-MS.

Lea, J.F. , et al.; Electrical Submersible Pumps: On and Offshore Problems and Solutions; Published Oct. 10, 1994; Society of Petroleum Engineers; Veracruz, Mexico; Retrieved May 17, 2018, from URL: https://www.onepetro.org/conference-paper/SPE-28694-MS.

* cited by examiner

CABLE PACK-OFF APPARATUS FOR WELL HAVING ELECTRICAL SUBMERSIBLE PUMP

CROSS REFERENCE TO RELATED APPLICATIONS

This application claims the benefit of U.S. Ser. No. 62/635,425 filed Feb. 26, 2018. That application is entitled "Cable Pack-Off Apparatus For Well Having Electrical Submersible Pump," and is incorporated by reference herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery from subsurface formations. More specifically, the present invention relates to artificial lift operations for pumping hydrocarbon fluids to the surface of a wellbore. The invention also relates to a means for sealing a wellbore when a power cable (or other transmission line) is pulled out of the well head.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. The final string of casing, referred to as a production casing, is also typically cemented into place.

To prepare the wellbore for the production of hydrocarbon fluids, a string of tubing is run into the casing. A packer is optionally set at a lower end of the tubing to seal an annular area formed between the tubing and the surrounding strings of casing. The tubing then becomes a string of production pipe through which hydrocarbon fluids may be lifted.

As part of the completion process, the production casing is perforated at a desired level. Alternatively, a sand screen may be employed in the event of an open hole completion. Either option provides fluid communication between the wellbore and a selected zone in a subsurface formation. A well head is installed at the surface. The well head will typically include a tubing head and a liner hanger. The production string is threadedly connected to the liner hanger, and is then gravitationally hung from the tubing head.

At the beginning of production, the formation pressure is typically capable of driving reservoir fluids up the production tubing and to the surface. However, reservoir pressure can be quickly depleted, or "drawn down," forcing the operator to convert the well to artificial lift.

One form of artificial lift sometimes used employs an electrical submersible pump. An electrical submersible pump, or "ESP," is a pump that operates with a motor downhole. The ESP is installed at a lower end of the production tubing and "pumps" production fluids up the tubing and to the well head. This avoids the use of a large reciprocating pumping unit at the surface and a long "sucker rod string" running downhole to a traveling valve.

A downside to the use of ESP's is that they require high levels of electrical power. This power is fed to the pump downhole by means of a long, heavily insulated power cable. The power cable and any other conduit must be routed through the well head at the surface, such as by using an auxiliary port in the tubing head.

Several patents have issued that discuss ways of providing an auxiliary port for a tubing head. A very early example is U.S. Pat. No. 3,437,149 entitled "Cable Feed-Through Means and Method For Well Head Construction." Improvements to the tubing head of the '149 patent were offered years later in U.S. Pat. No. 4,154,302, also entitled "Cable Feed-Through Method and Apparatus For Well Head Construction." Later still, U.S. Pat. No. 6,530,433 entitled "Well head With ESP Cable Pack-Off For Low Pressure Applications" issued. Each of these patents seeks to provide a way of feeding a power cable through the well head while still providing a fluid seal for the wellbore.

Where an ESP is used at the bottom of the wellbore, the service company will band the power cable to the joints of tubing as the tubing string is run into the wellbore, joint by joint. Additional signal cables and even a chemical injection line may be banded with the power cable, such as through a co-insulated line.

Once the production tubing is run into the wellbore and the liner hanger is hung from the tubing head, the service company will run the power cable and any other transmission lines into the auxiliary port. A corresponding power cable will be run from a power source, sometimes known as "shore power," and spliced into the power cable. To provide such access, a plug-in joint has historically been provided along the well head wherein a power cable at the surface is spliced and placed in electrical communication with the power cable in the wellbore leading down to the pumping equipment to be powered.

One problem encountered by operators in the upstream oil and gas industry is an occurrence called "parted tubing." "Parted tubing" means that the string of production tubing, which is suspended in the wellbore from the tubing hanger at the well head, has separated. This is frequently due to a defective or thin portion of pipe, creating a point of weakness.

Those of ordinary skill in the art will understand that a wellbore is filled with corrosive and sometimes abrasive and acidic fluids held at high pressures. In addition, the wellbore can experience very high temperatures. This environment is hard on the steel tubing joints, and can also create points of weakness or fatigue that can lead to a break, or "parting" in the production string. The portion that breaks off, which may be many thousands of feet in length, will gravitationally fall to the bottom of the wellbore. When this happens, the ESP will fall with the tubing string and be lost.

When a well experiences parted tubing, the power cable in the wellbore will be severed. Since the power cable and any other transmission lines are banded to the production tubing during the completion process, the lines will break as well. When the lines are broken, the operator will want to remove the plug-in joint and pull the power cable and other transmission lines out of the well head. However, this leaves a void in the well head where the cables once passed through the auxiliary port located on the tubing hanger.

Accordingly, a need exists for an apparatus that may be connected to a known auxiliary port that maintains a seal when the power cable and other lines are pulled from the well head. Further, a need exists for a method of pulling a broken power cable from a well head without leaving a void, thereby providing a self-sealing barrier against the loss of petroleum products, water, and gases that could otherwise leak from the wellbore and through the auxiliary port.

SUMMARY OF THE INVENTION

A cable pack-off apparatus is first provided. The cable pack-off apparatus is configured to threadedly connect to an auxiliary port along a tubing head. The tubing head, in turn, is part of a well head used to isolate a wellbore and to support the production of hydrocarbon fluids. The cable pack-off apparatus allows a field supervisor (or "pumper") to pull a power cable from the well head when a well experiences a condition of parted tubing. Beneficially, the cable pack-off apparatus is self-sealing, thereby preventing the wellbore from being exposed to the atmosphere when the power cable is removed.

The cable pack-off apparatus first comprises a pack-off housing. The pack-off housing is a tubular body defining a proximal end and a distal end. A central bore passes through the tubular body from the proximal end to the distal end, and is configured to receive one or more transmission lines.

The one or more transmission lines preferably includes a power cable. Optionally, the transmission lines include a chemical injection line or a fiber optic cable connected to a downhole sensor. It is preferred that the cable pack-off apparatus be configured to convey three transmission lines, including a power cable. The power cable extends to an electric downhole device in the wellbore below the tubing head, such as an electrical submersible pump or, perhaps, a resistive heater.

The cable pack-off apparatus also includes an open-ended plug. The open-ended plug is configured to be received within the distal end of the pack-off housing. The plug facilitates the power cable moving from the well head to a power distribution box.

The cable pack-off apparatus additionally includes a connector. The connector is placed at a proximal end of the pack-off housing, opposite the open-ended plug. The connector is configured to connect the pack-off housing to the auxiliary port while permitting the one or more transmission lines to pass from the pack-off housing and into the auxiliary port. Preferably, this is a threaded connector.

The cable pack-off apparatus also comprises an elastomeric packing element. The packing element is configured to receive the one or more transmission lines within the central bore. In one aspect, the packing element comprises fingers that extend from a tubular body, wherein each of the fingers comprises a through-opening configured to closely receive a respective transmission line. The packing element is configured to seal the power cable and any other individual lines along the central bore of the tubular body.

The cable pack-off apparatus further has at least one sealing ball. Each sealing ball is configured to fall into the central bore and to block a corresponding through-opening of the packing element when a transmission line is pulled from the auxiliary port and out of the open-ended plug. Alternatively, the sealing ball falls in response to the production tubing falling in the wellbore and dragging the power cable down entirely out of the well head.

In one aspect, the pack-off housing comprises a shoulder formed around the tubular body. The shoulder defines an area of enlarged outer diameter of the tubular body. A sloped surface is provided along the shoulder. The sloped surface comprises one or more passages, wherein each passage receives one of the sealing balls. The sealing balls are biased to enter the central bore of the pack-off housing from an angle. Preferably, the approach is at an angle of 45° relative to the central bore.

In one embodiment of the cable pack-off apparatus, each of the passages receives a sealing ball, a biasing spring to bias the sealing ball into the central bore of the pack-off housing, and a threaded end cap. The end cap removably seals the through-opening. Additionally, each threaded end cap holds the biasing spring within its respective passage in compression.

The cable pack-off apparatus may additionally include a ball entry guide. The ball entry guide is configured to be slidingly received within the central bore of the pack-off housing. The ball entry guide includes one or more channels, with each channel being configured to receive a respective sealing ball when a corresponding transmission line is removed from the auxiliary port and the central bore of the pack-off housing.

Along with the ball entry guide, the cable pack-off apparatus may have a ball seat. The ball seat has a proximal end and a distal end, and at least two channels extending there through. The ball seat is configured to land on the elastomeric body within the central bore of the pack-off housing. At the same time, each channel of the ball seat engages a respective finger of the packing element, and aligns with a respective channel of the ball entry guide and a respective through-opening of the packing element.

The open-ended plug is threadedly connected to the distal end of the pack-off housing. In this way, the open-ended plug holds the ball entry guide, the ball seat and the elastomeric packing element within the central bore of the pack-off housing together in compression.

In a preferred embodiment of the cable pack-off apparatus, the sloped surface of the pack-off housing comprises three passages equi-radially spaced about the sloped surface of the shoulder. Similarly, each of the ball entry guide and the ball seat comprises three channels, while the packing element comprises three equi-radially spaced fingers.

As an option, in addition to using three sealing balls (one for each finger), the cable pack-off apparatus may also have three locking balls. Each of the locking balls resides within a respective passage in the shoulder of the pack-off housing, between the associated sealing ball and spring. Further, each of the locking balls has a diameter that is too large to pass through its respective passage in the ball seat when its associated sealing ball falls into the ball seat, and thereby forms a fluid seal within the passage. Thus, the cable pack-off apparatus is self-sealing.

A method of sealing a tubing head over a wellbore is also provided herein. In one aspect, the method first comprises identifying a wellbore having a tubing head. The tubing head has a tubing hanger that is connected to a tubing string which extends down into the wellbore. The tubing hanger and connected tubing string are together gravitationally supported by the tubing head.

The method also includes identifying an auxiliary port along the tubing head. The auxiliary port conveys one or more transmission lines from the wellbore and through the tubing head.

Further, the method includes providing a cable pack-off apparatus. The cable pack-off apparatus is configured in accordance with any of the embodiments described above.

The method then comprises connecting the cable pack-off apparatus to the auxiliary port along the tubing head. In this way, the at least one transmission line passes from a power distribution box, through the open-ended plug, through the central bore of the cable pack-off apparatus, through the connector, through the auxiliary port in the tubing head, and into the wellbore. In one aspect, connecting the cable pack-off apparatus to the auxiliary port comprises threadedly connecting the pack-off housing to the auxiliary port while permitting the power cable to pass from the auxiliary port, through the pack-off housing, and out through the open-ended plug.

In a preferred embodiment, the method also includes:

identifying a condition of parted tubing within the wellbore;

shutting off electrical power to the power cable; and pulling a remaining portion of the power cable from the central bore of the pack-off housing, thereby allowing the at least one sealing ball to fall into the central bore.

In this way, the wellbore is sealed to the surface.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
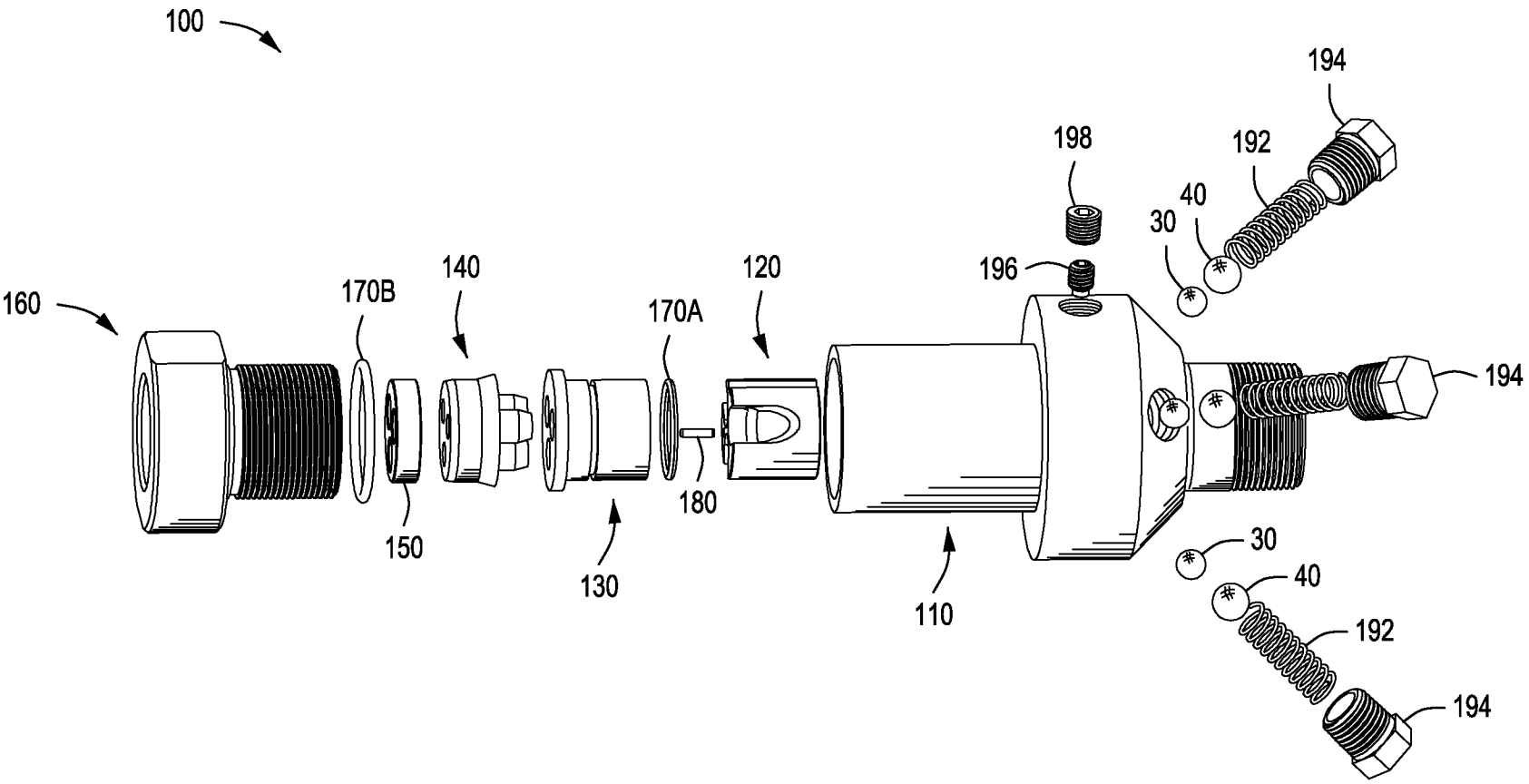
FIG. 1 is a side perspective view of a cable pack-off apparatus of the present invention. The apparatus is used to self-seal a side port in a tubing hanger. Here, components of the pack-off apparatus are in exploded-apart relation.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and fines.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." When used in the context of a wellbore, the term "bore" refers to the diametric opening formed in the subsurface through the drilling process.

Description of Selected Specific Embodiments

FIG. 1 is a side perspective view of a cable pack-off apparatus 100 of the present invention. The apparatus 100 is used to self-seal a side port (or "auxiliary port") along a tubing head when a power cable is pulled from a well head at the surface. "Pulling" may be from the surface up or from the wellbore down.

Figure 15:
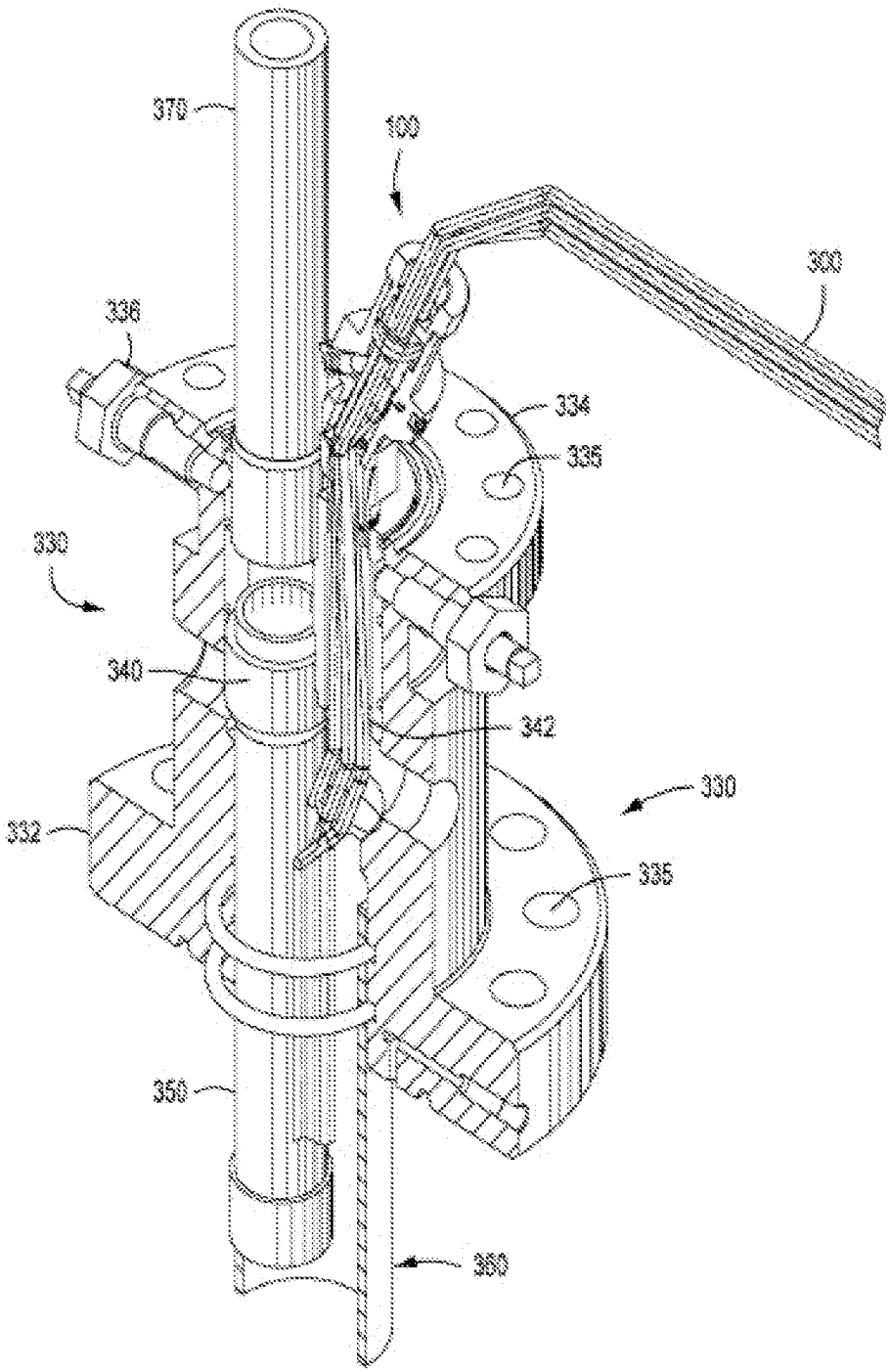
FIG. 15 is a cut-away view of a tubing head (or "tubing spool") as used to support a production tubing within a wellbore. The tubing head includes an auxiliary port that receives power wires that pass through the tubing head en route to the wellbore and then downhole to an electrical device.

The cable pack-off apparatus 100 is configured to threadedly connect to the auxiliary port along the tubing head. This connection is shown in FIG. 15 and is discussed in detail below. The tubing head, in turn, is part of a well head used to isolate a wellbore and to support the production of hydrocarbon fluids. The cable pack-off apparatus 100 allows a field supervisor (or "pumper") to pull an upper severed portion of a power cable (shown best at 310 in FIGS. 16A and 16B) from the well head when the well experiences a condition of parted tubing.

In FIG. 1, components of the pack-off apparatus 100 are shown in exploded-apart relation. The dominant feature of the pack-off apparatus 100 is a pack-off housing 110.

Figure 1A:
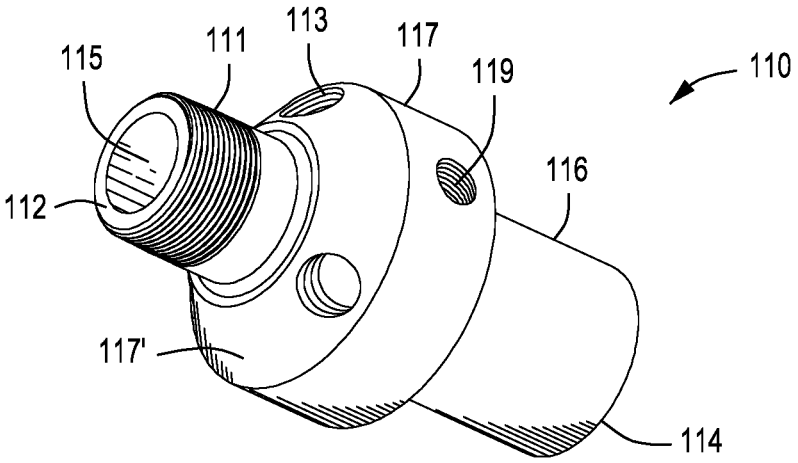
FIG. 1A is a perspective view of a housing for the cable pack-off apparatus of FIG. 1.
Figure 1B:
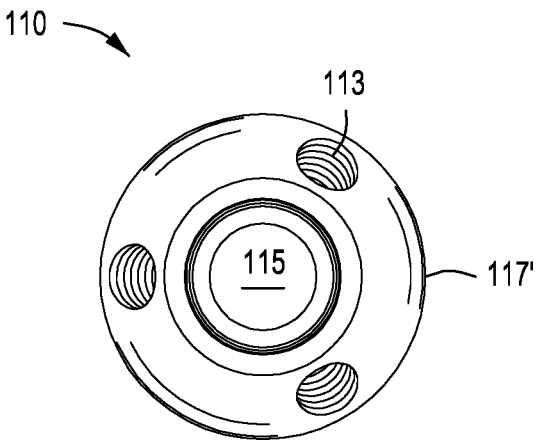
FIG. 1B. is an end view of the housing of FIG. 1A.
Figure 1C:
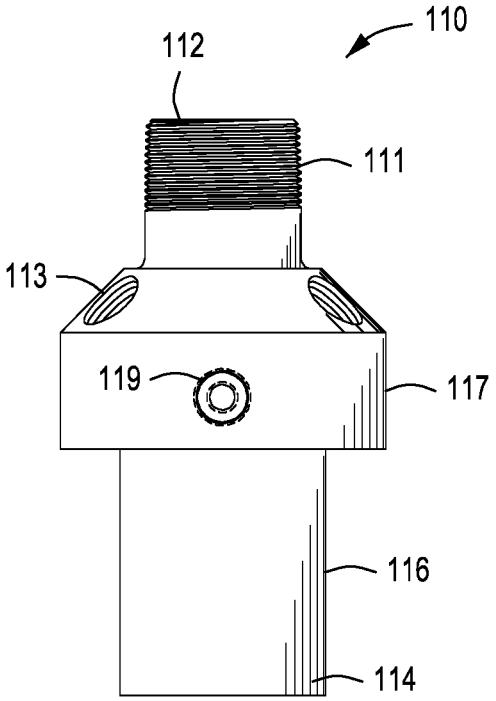
FIG. 1C is a side view of the housing of FIG. 1A.

FIG. 1A is a perspective view of the pack-off housing 110 for the cable pack-off apparatus 100 of FIG. 1. FIG. 1B is an end view of the housing 110, while FIG. 1C is a side view. The pack-off housing 110 will be described with reference to FIGS. 1A, 1B and 1C together.

The pack-off housing 110 defines a tubular body 116. The tubular body 116 is preferably fabricated from steel, forming a pressure vessel. The tubular body 116 has a proximal end 112 and a distal end 114. A central bore 115 is formed in the body 116 extending from the proximal end 112 to the distal end 114. The central bore 115 is configured to convey transmission lines (shown generally at 300 in FIG. 15) to an auxiliary port in the tubing head.

The proximal end 112 of the housing 110 comprises external threads 111, forming a male connector end. The male connector end 111 is configured to screw into the auxiliary port. Thus, the proximal end 112 is, in most operations, a lower end of the pack-off housing 110.

The tubular body 116 includes an area having an enlarged outer diameter 117. The enlarged outer diameter portion 117 forms a lower shoulder 117'. Passages 113 are formed through the shoulder 117 and into the central bore 115. The passages 113 are angled relative to the central bore 115. The angle may be, for example, between 30 and 75 degrees, but most preferably is at about 40°.

Figure 9A:
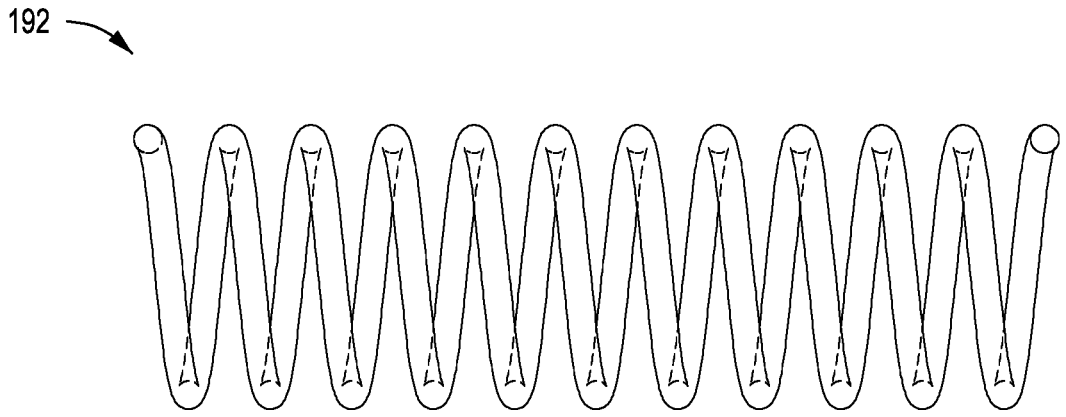
FIG. 9A is a side view of a spring configured to reside within a channel of the housing of FIG. 1A.
Figure 13:
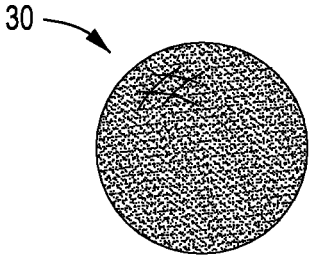
FIG. 13 is a side view of an illustrative sealing ball as may be installed into passages machined into the housing of FIG. 1A.
Figure 14:
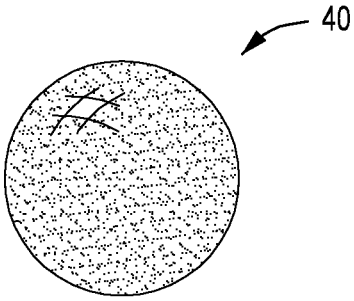
FIG. 14 is a side view of an illustrative locking ball as may also be installed into passages machined into the housing of FIG. 1A.

In a preferred arrangement, the shoulder 117' receives three equi-radially spaced passages 113. Each of the passages 113 is dimensioned to slidably receive a spring. Springs 192 are shown in FIG. 1 and FIG. 9A. In addition, each of the passages 113 receives a sealing ball. Sealing balls 30 are shown in FIG. 1 and FIG. 13. Optionally, each of the passages 113 further receives a locking ball. Locking balls 40 are shown in FIG. 1 and FIG. 14.

Figure 10A:
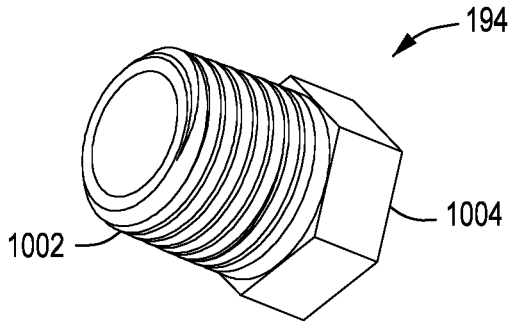
FIG. 10A is a perspective view of an end cap as used to hold the spring of FIG. 9A within a passage of FIG. 1A.

An end cap is provided at the end of each passage 113. End caps 194 are shown in FIG. 1 and FIG. 10A. The end caps 194 fluidly seal the passages 113. More importantly, the end caps 194 hold the springs 192 in compression within the respective passages 113.

Figure 11A:
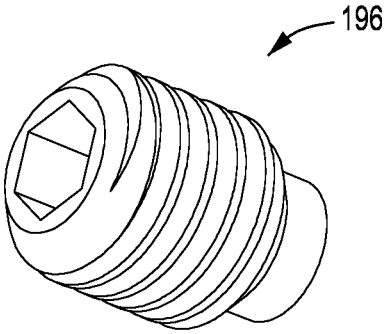
FIG. 11A is a perspective view of an alignment set screw as used with the housing of FIG. 1A.
Figure 12A:
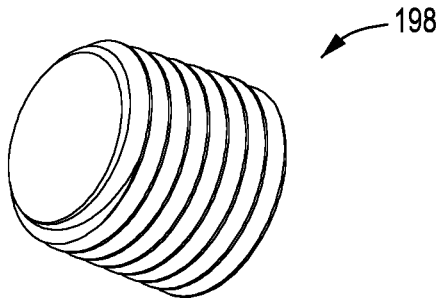
FIG. 12A is a perspective view of a NPT seal screw as used with the housing of FIG. 1A.
Figure 16A:
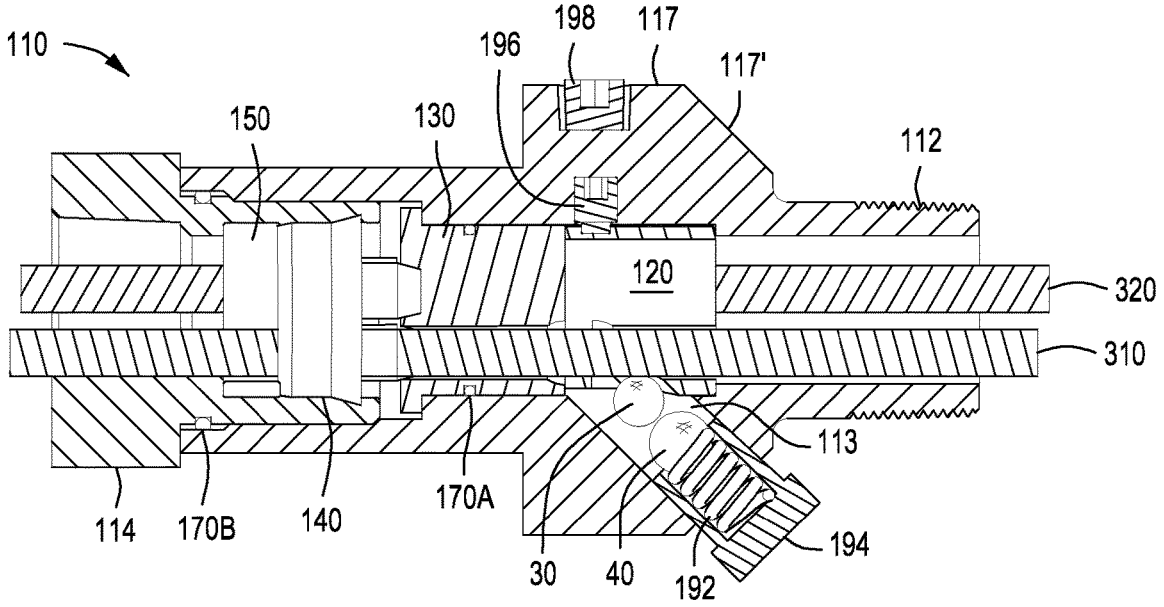
FIG. 16A is a first cross-sectional view of the cable pack-off apparatus of FIG. 1. Here, a pair of transmission lines is passing through the pack-off housing of FIG. 1A.

Finally, the shoulder 117 comprises a side opening 119. The side opening 119 receives a set screw. The set screw 196 is shown in FIGS. 11A and 16A. The opening 119 also receives a NPT seal screw. The seal screw 198 is seen in FIGS. 12A and 16A.

As shown in FIG. 1, various components reside within the central bore 115 of the pack-off housing 110. A first of these components is a ball entry guide 120.

Figure 2A:
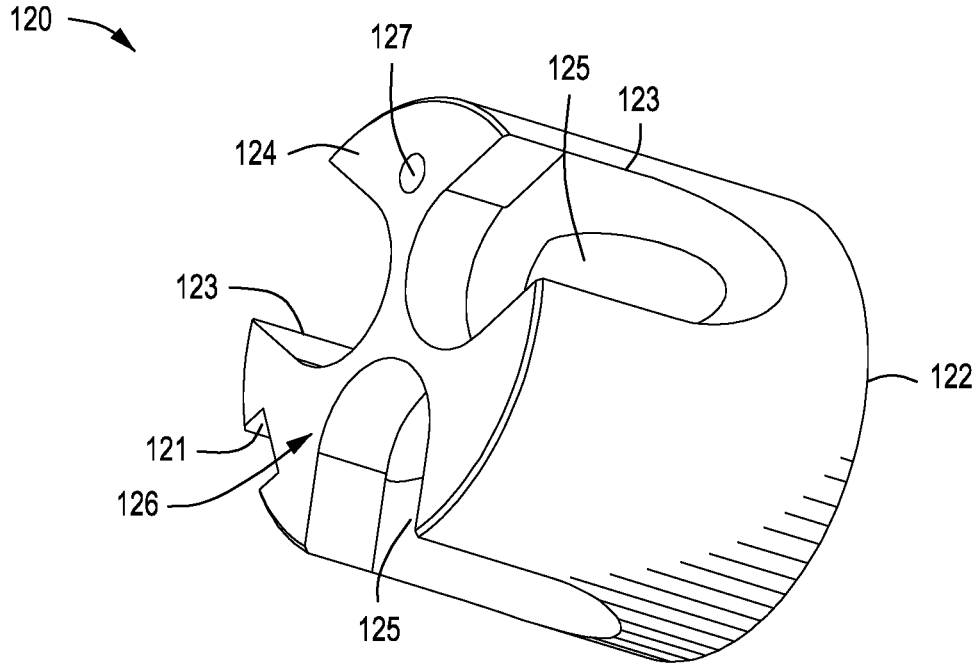
FIG. 2A is a first perspective view of a ball entry guide, configured to reside within the housing of FIG. 1A. Here, the view is taken from an upper end.
Figure 2B:
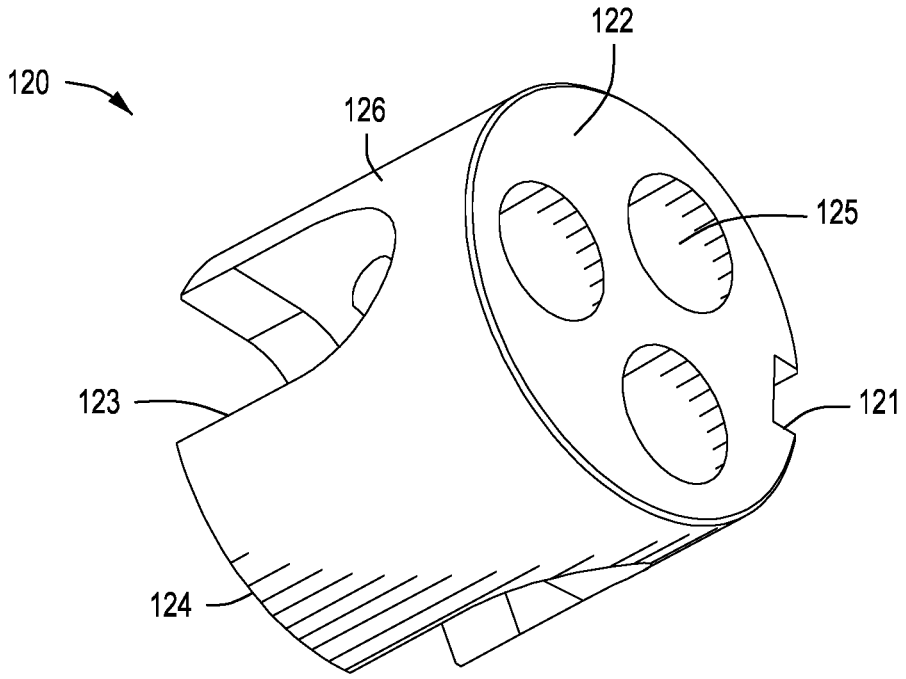
FIG. 2B is a second perspective view of the ball entry guide of FIG. 2A. Here, the view is taken from a lower end.
Figure 2C:
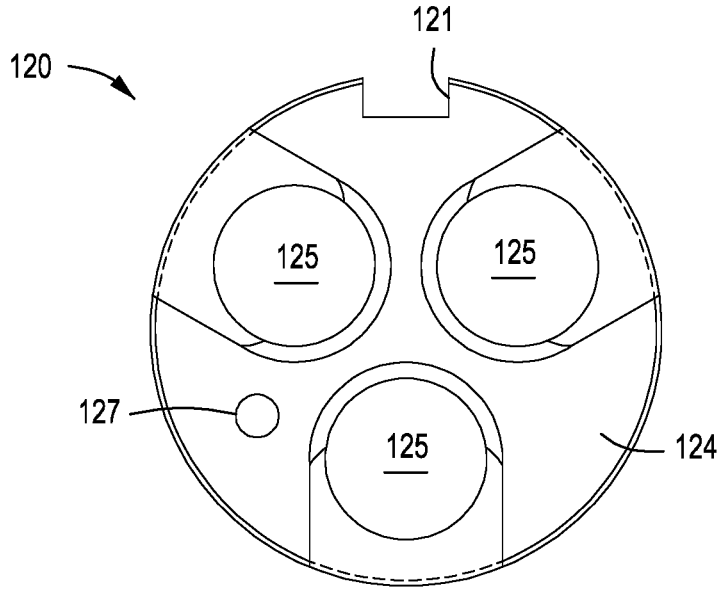
FIG. 2C is a top view of the ball entry guide of FIGS. 2A and 2B.
Figure 2D:
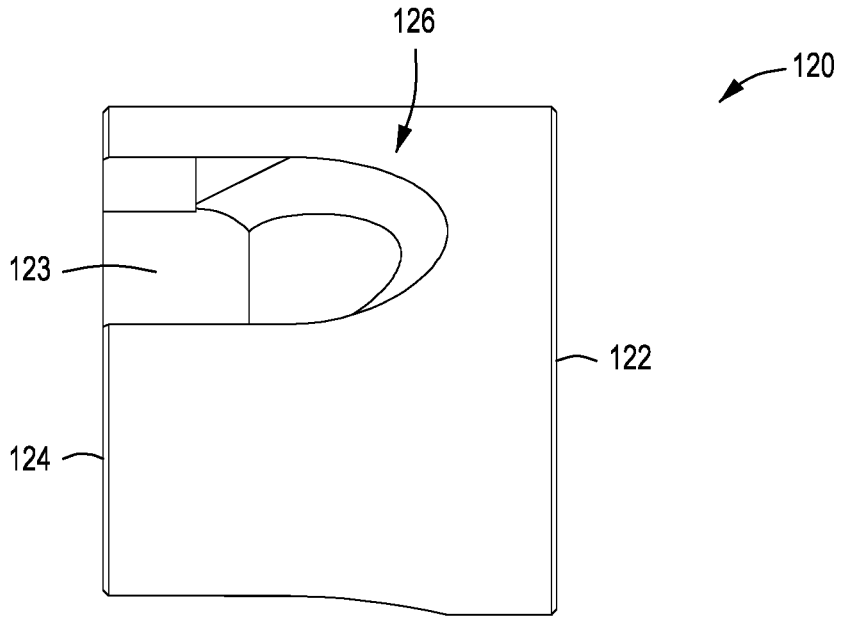
FIG. 2D is a side view of the ball entry guide of FIGS. 2A and 2B.

FIG. 2A is a first perspective view of a ball entry guide 120. Here, the view is taken from an upper (or distal) end 124. FIG. 2B is a second perspective view of the ball entry guide 120. Here, the view is taken from a lower (or proximal) end 122. FIG. 2C is a top view of the ball entry guide 120 of FIGS. 2A and 2B, while FIG. 2D is a side view of the ball entry guide 120. The ball entry guide 120 will be discussed with reference to FIGS. 2A, 2B, 2C and 2D together.

The ball entry guide 120 represents a brass or steel body 126. The body 126 receives separate channels 125. Each channel 125 is configured to receive a transmission line, such as lines 310 or 320 of FIG. 16A. Each channel 125 defines an opening dimensioned to receive a sealing ball 30 followed by a locking ball 40 when the apparatus 100 is activated, as discussed further below.

Figure 16B:
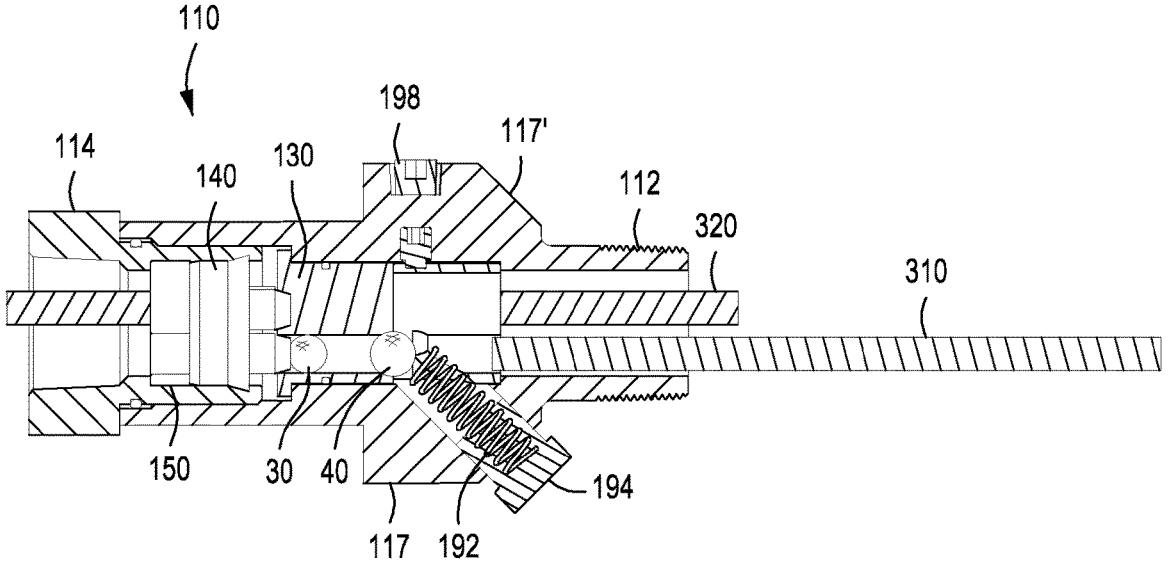
FIG. 16B is a second cross-sectional view of the cable pack-off apparatus of FIG. 1. Here, one of the illustrative transmission lines has broken off, causing the cable pack-off apparatus to self-seal.

As the channel 125 moves from the proximal end 122 to the distal end 124, the channel 125 turns into a through-opening 123. Each through-opening 123 is configured to sealingly receive a sealing ball 30 when the transmission line 310 is removed (or pulled) from the channel 125. This condition is shown in FIG. 16B.

Finally, the ball entry guide 120 comprises a rectangular slot 121. The slot 121 is formed in the body 126. The slot 121 is configured to receive the set screw 196. In this way, the position of the ball guide 120 within the central bore 115 is fixed.

A next component of the cable pack-off apparatus 110 is a ball seat 130. The ball seat 130 resides above the ball entry guide 120 within the central bore 115 of the housing 110.

Figure 3A:
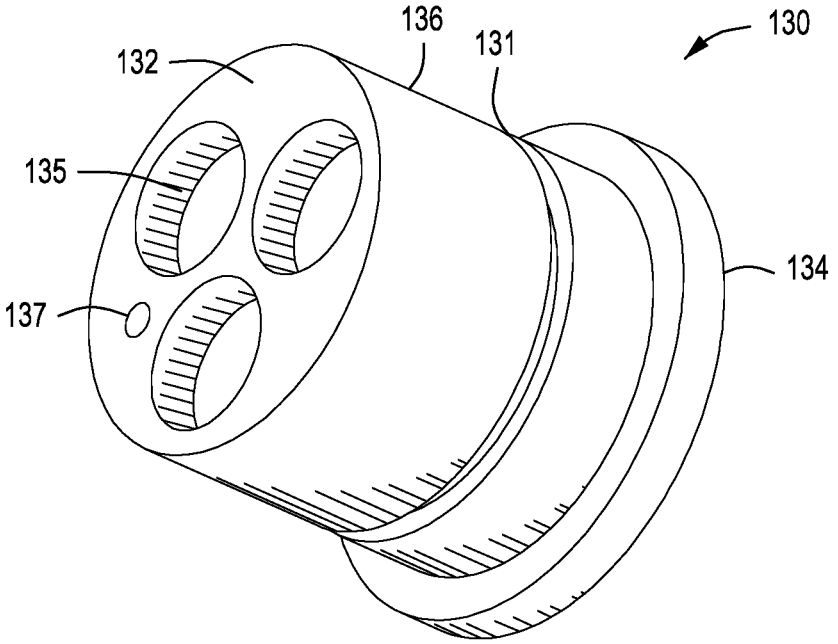
FIG. 3A is a first perspective view of a ball seat, also configured to reside within the housing of FIG. 1A. Here, the view is taken from a lower end.
Figure 3B:
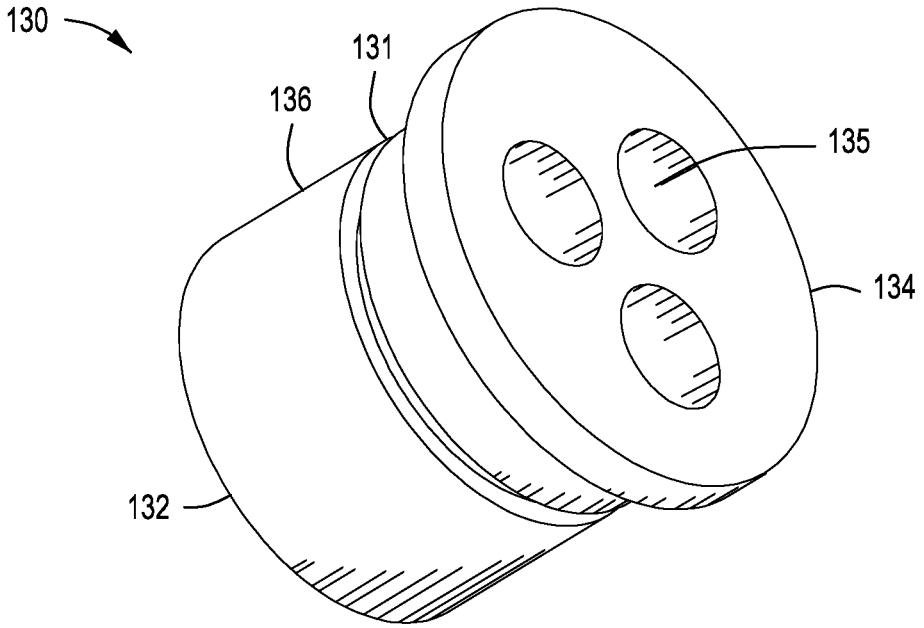
FIG. 3B is a second perspective view of the ball seat of FIG. 3A. Here, the view is taken from an upper end.
Figure 3C:
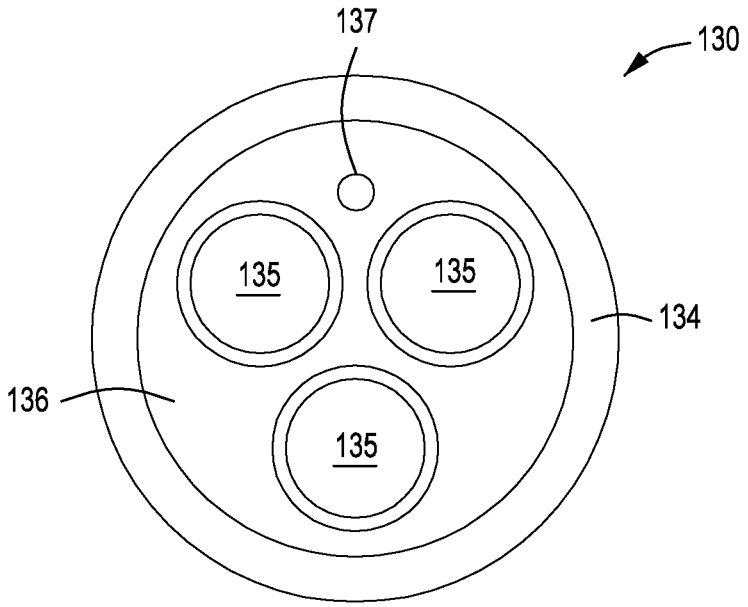
FIG. 3C is a bottom view of the ball seat of FIGS. 3A and 3B.
Figure 3D:
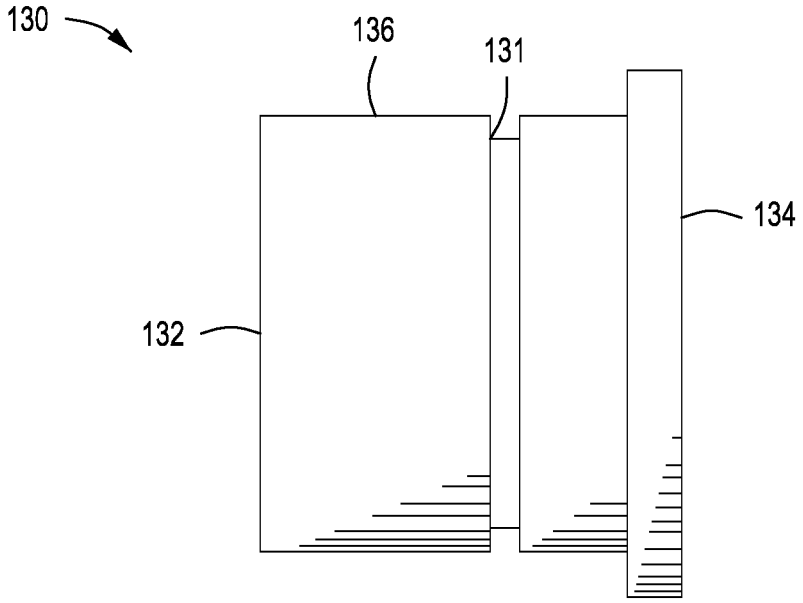
FIG. 3D is a side view of the ball seat of FIGS. 3A and 3B.

FIG. 3A is a first perspective view of the ball seat 130. Here, the view is taken from a lower (or proximal) end 132. FIG. 3B is a second perspective view of the ball seat 130 of FIG. 3A. Here, the view is taken from an upper (or distal) end 134. FIG. 3C is a top view of the ball seat 130, while FIG. 3D is a side view. The ball seat 130 will be discussed with reference to FIGS. 3A, 3B, 3C and 3D together.

The ball seat 130 also represents a brass or steel body 136. The body 136 receives separate channels 135. Each channel 135 is configured to receive a transmission line, such as lines 310 or 320 of FIG. 16A. The channels 135 are designed to align with channels 125 of the ball guide 120.

Figure 7A:
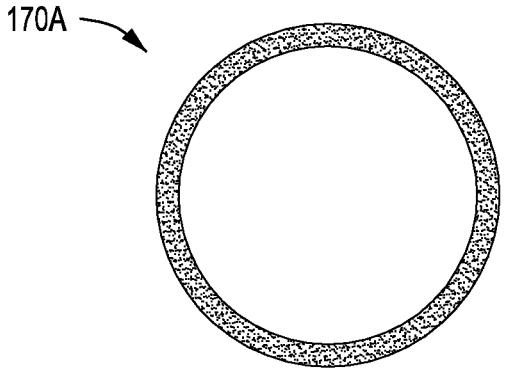
FIG. 7A is an end view of an illustrative o-ring as may be used to seal components within the housing of FIG. 1A.

An annular ring 131 is provided around the body 136. The annular ring 131 is designed to receive a seal ring. The seal ring 170A is shown in FIGS. 1 and 7A. The seal ring 170A provides a fluid seal between the ball seat 130 and the surrounding tubular body 116 within the central bore 115.

Yet a next component of the cable pack-off apparatus 110 is a packing element 140. The packing element 140 resides above the ball seat 130 within the central bore 115 of the housing 110. The packing element 140 is preferably made of hydrogenated nitrile butadiene rubber (HBNR) to resist typical oil well contaminates and petrochemicals produced by the well.

Figure 4A:
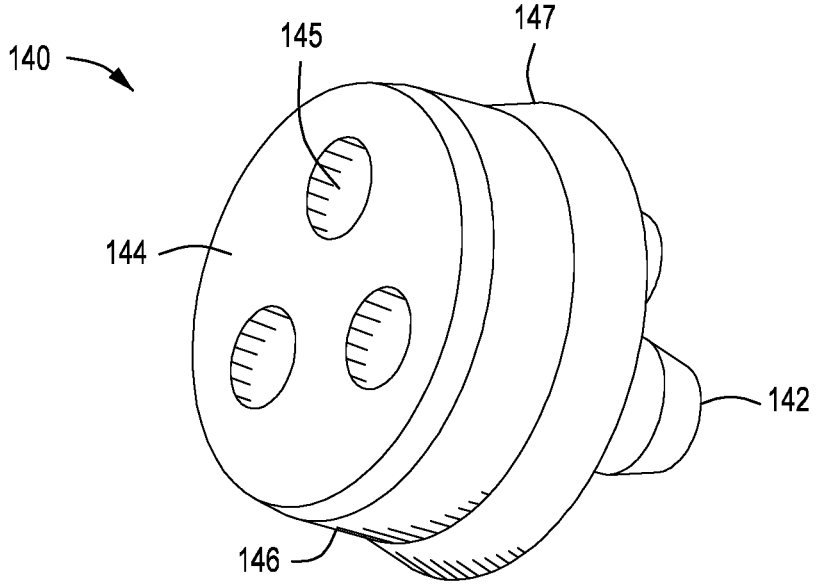
FIG. 4A is first perspective view of an elastomeric packing element, also configured to reside within the housing of FIG. 1A. Here, the view is taken from an upper end.
Figure 4B:
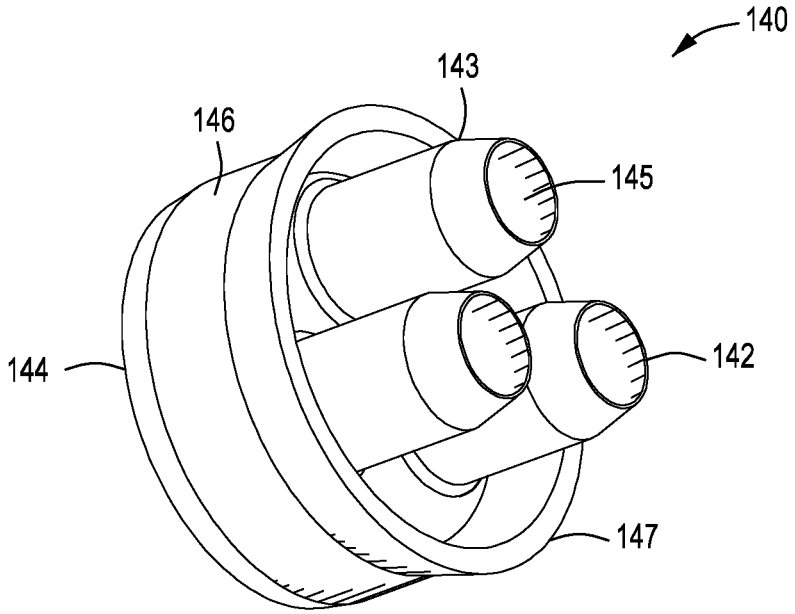
FIG. 4B is a second perspective view of the packing element of FIG. 1A. Here, the view is taken from a lower end, showing fingers extending away from a tubular body.
Figure 4C:
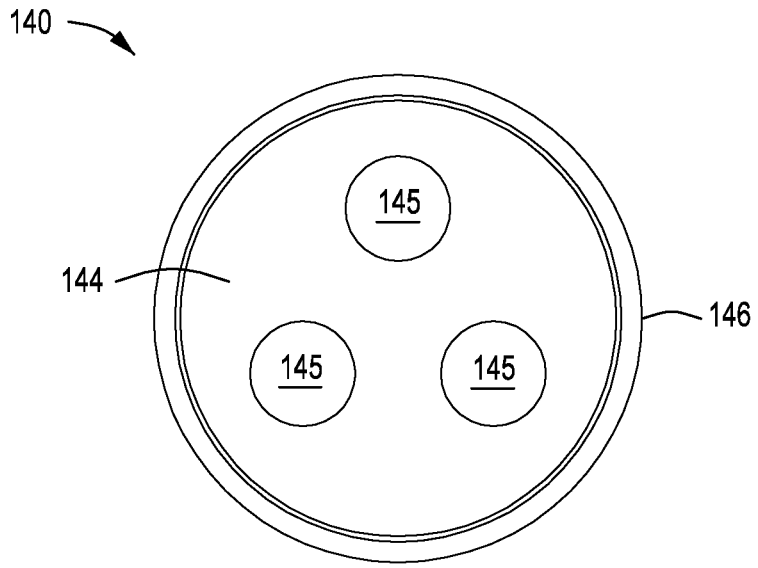
FIG. 4C is an upper end view of the packing element of FIGS. 4A and 4B.
Figure 4D:
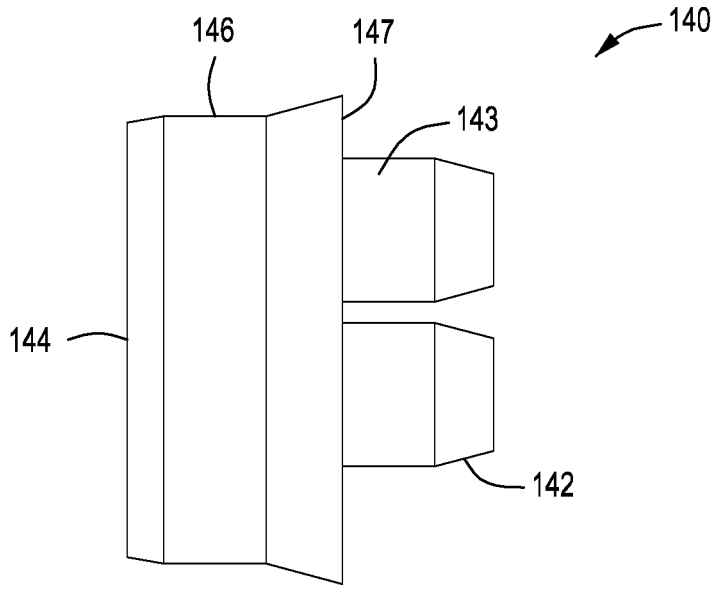
FIG. 4D is a side view of the packing element of FIGS. 4A and 4B.

FIG. 4A is first perspective view of the packing element 140. Here, the view is taken from an upper (or distal) end 144. FIG. 4B is a second perspective view of the packing element 140. Here, the view is taken from a lower (or proximal) end 142. FIG. 4C is a bottom view of the packing element 140, while FIG. 4D is a side view of the packing element of FIGS. 4A and 4B. The packing element 140 will be discussed with reference to FIGS. 4A, 4B, 4C and 4D together.

The packing element 140 defines an elastomeric body 146. The elastomeric body 146 forms a shoulder 147. The elastomeric body 146 receives separate channels 145. Each channel 145 is configured to receive a transmission line, such as lines 310 or 320 of FIG. 16A. Three channels 145 are provided in the illustrative embodiment of FIGS. 4A, 4B, 4C and 4D.

Of interest, distinct fingers 143 extend from each respective channel 145. Each finger 143 continues the channel 145, and is dimensioned to closely receive a respective transmission line, such as a power cable 310. The distal end 142, at the tip of each finger 143, is tapered so as to sealingly contact a corresponding channel 135 within the ball seat 130. When the packing element 140 is compressed against the ball seat 130, the fingers 143 will collapse down around the associated transmission line, e.g., power cable 310.

Figure 5A:
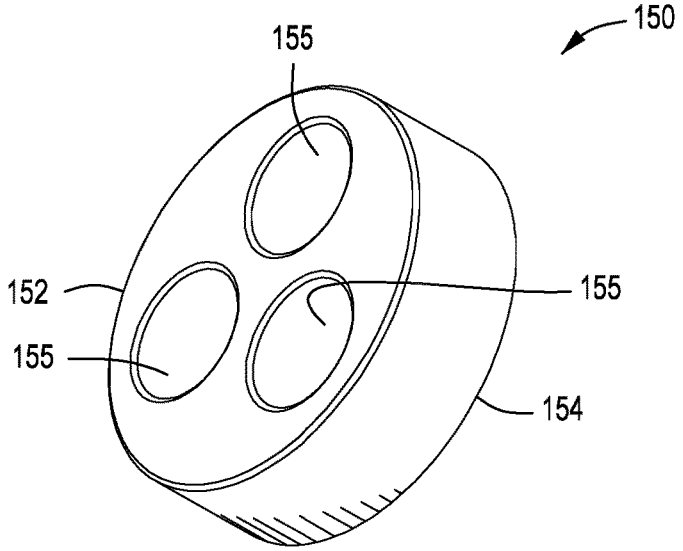
FIG. 5A is a perspective view of a spacer configured to reside within the housing of FIG. 1A. Here, the view is taken from a lower end.
Figure 5B:
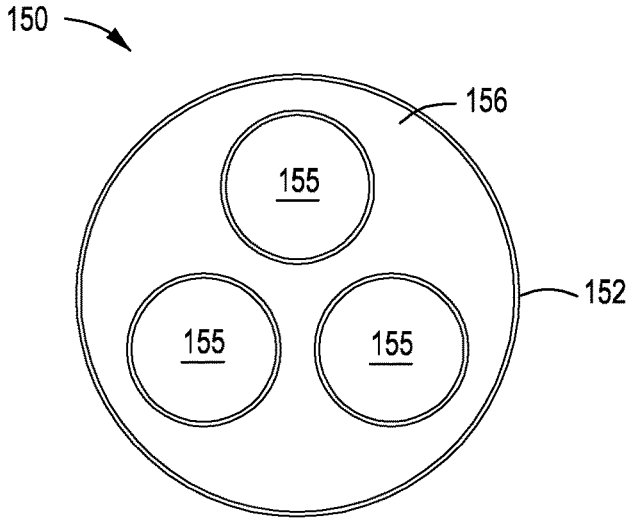
FIG. 5B is a bottom view of the spacer of FIG. 5A.
Figure 5C:
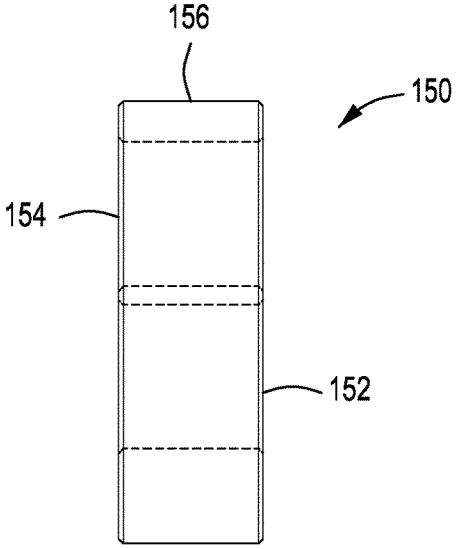
FIG. 5C is a side view of the spacer of FIG. 5A.

An optional component in the cable pack-off apparatus 100 is a spacer 150. FIG. 5A is a perspective view of an illustrative spacer 150. FIG. 5B is a bottom view of the spacer 150 of FIG. 5A, while FIG. 5C is a side view. The spacer 150 will be discussed with reference to FIGS. 5A, 5B and 5C together.

The spacer 150 defines a disc-shaped body 156 having a proximal end 152 and a distal end 154. Preferably, the spacer 150 is fabricated from brass or steel. The body 156 of the spacer 150 has a plurality of through-openings 155. In the illustrative view of FIGS. 5A, 5B and 5C, three separate through-openings 155 are shown, with each through-opening 155 being sized to receive a power cable 310 or other transmission line.

The spacer 150 is configured to reside within the central bore 115 of the pack-off housing 110, above the packing element 140. The spacer 150 provides protection to the packing element 140 in case of pressure below the pack-off housing 110 becoming too great, pushing the packing element 140 towards the distal end of the apparatus 100.

It is noted that within the central bore 115, the through-openings 155 of the spacer 150 are aligned with the fingers 143 of the packing element 140. The fingers 143 of the packing element 140, in turn, are aligned with the channels 135 of the ball seat 130 and then with the channels 125 of the ball entry guide 120. In this way, transmission lines 310, 320 may be run through the central bore 115 continuously.

The transmission lines 310, 320 may be data cables or power cables. In addition, the transmission lines may include a chemical injection line. The chemical injection line is preferably a small-diameter, stainless steel tubing that extends down into the wellbore 360 and terminates at the pump inlet. In this way, treating fluid is delivered proximate the ESP (not shown) to treat the pump hardware.

Figure 6A:
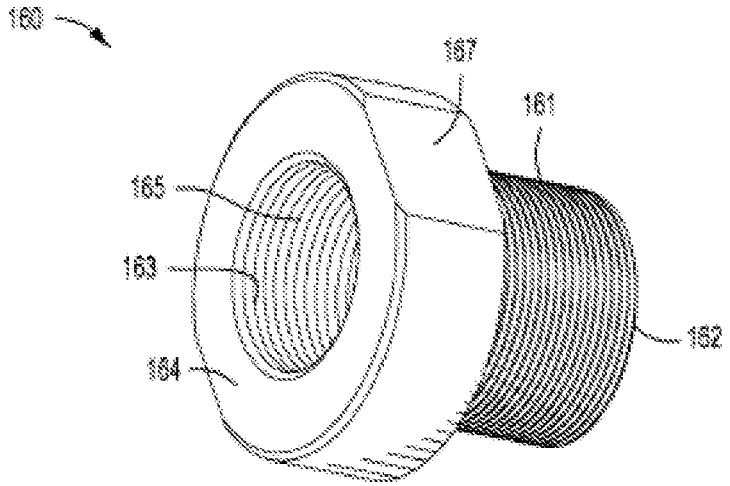
FIG. 6A is a perspective view of an open-ended plug of the cable pack-off apparatus of FIG. 1. The open-ended plug is configured to threadedly connect to an upper end of the housing of FIG. 1A. The view is taken from an upper end.
Figure 6B:
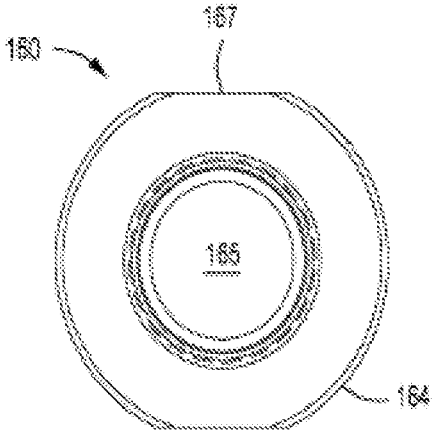
FIG. 6B is a top end view of the plug of FIG. 6A.
Figure 6C:
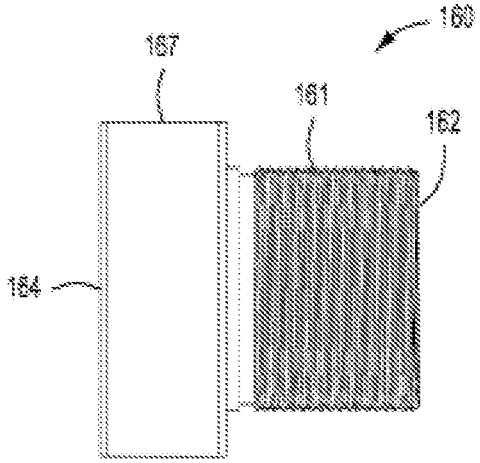
FIG. 6C is a side view of the plug of FIG. 6A.

An additional component of the cable pack-off apparatus 100 is an open-ended plug 160. FIG. 6A is a perspective view of the open-ended plug 160 of the cable pack-off apparatus 100 of FIG. 1. FIG. 6B is an end view of the plug 160, while FIG. 6C is a side view. The plug 160 will be discussed with reference to FIGS. 6A, 6B and 6C together.

The open-ended plug 160 has a lower (or proximal) end 162 and an upper (or distal) end 164. A bore 165 runs through the plug 160 from the proximal 162 to the distal 164 end. The proximal end 162 defines a male threaded end (see male threads 161) while the distal end 164 defines a female threaded end (see female threads 163).

The open-ended plug 160 is configured to threadedly connect to an upper end 114 of the housing 110. Specifically, the male threads 161 screw into the central bore 115 of the housing 110, securing, in sequence, the spacer 150, the packing element 140, the ball seat 130 and the ball guide 120. A "flat" 167 is provided along a circumference of the proximal end 164 to aid in turning the open-ended plug 160 to make the connection. The female threads 163 may be 1¼" NPT thread so that conduit can be used to route electrical wires through the open-ended plug 160 and to the power distribution box.

Figure 7B:
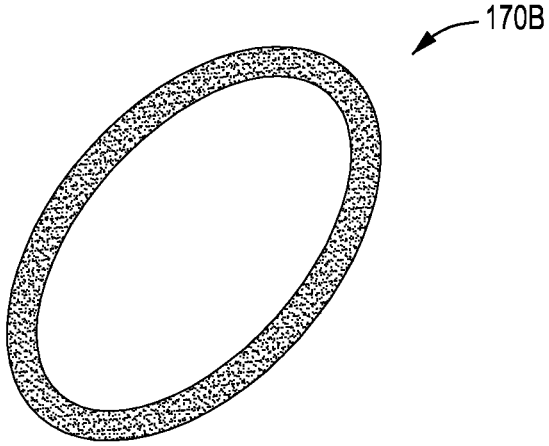
FIG. 7B is a perspective view of the o-ring of FIG. 7B.

Referring back to FIG. 1, two o-rings are shown as part of the cable pack-off apparatus 100. These are o-rings 170A and 170B. FIG. 7A is an end view of an illustrative o-ring 170A. FIG. 7B is a perspective view of the o-ring 170A of FIG. 7B. It is understood that o-rings 170A and 170B each define an elastomeric ring used to seal components within the housing 110 of FIG. 1A As discussed above, the o-ring 170A is placed within a slot 131 of the ball seat 130. The o-ring 170B is placed between the open-ended plug 160 and the spacer 150. These rings 170A, 170B help provide a fluid seal along the central bore 115, preventing the escape of wellbore fluids from the well head during production operations. Specifically, gases and other petroleum products are prevented from by-passing the o-rings 170A, 170B.

Figure 8A:
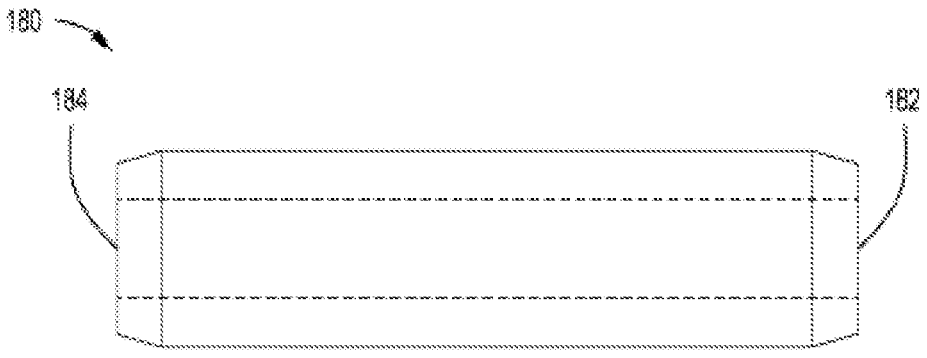
FIG. 8A is a side view of an alignment pin as used to align components of the housing of FIG. 1A. The alignment pin resides within the ball entry guide of FIGS. 2A and 2B and the ball seat of FIGS. 3A and 3B.
Figure 8B:
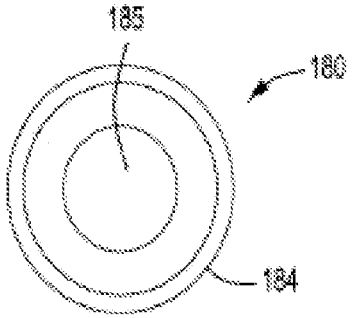
FIG. 8B is an end view of the alignment pin of FIG. 8A, shown from a lower end.

An additional component of the cable pack-off apparatus 100 is an alignment pin, 180. FIG. 8A is a side view of the alignment pin 180, while FIG. 8B is an end view, shown from a lower end. The alignment pin services as an aluminum "cotter pin," and resides within the ball entry guide 120 of FIGS. 2A and 2B.

The alignment pin 180 has a proximal end 182 and a distal end 184. A bore 185 extends there between. The alignment pin 180 fits into an opening 127 (shown in FIGS. 2A and 2C) of the ball guide 120, and further fits into an opening 137 (shown in FIGS. 3A and 3C) of the ball seat 130. When the pin 180 is placed into the adjacent openings 127, 137, this helps to align the ball guide 120 is aligned with the ball seat 130.

Referring again to FIG. 1A, it is noted that the pack-off housing 110 includes an enlarged outer diameter portion 117. The enlarged outer diameter portion 117 forms a shoulder 117' which includes a plurality of equi-radially placed passages 113. Each passage receives a sealing ball 30, a locking ball 40 and a spring 192, in order.

Figure 9B:
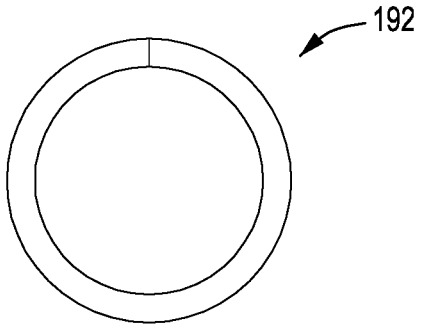
FIG. 9B is an end view of the spring of FIG. 9A.

FIG. 9A is a side view of the spring 192, which is configured to reside within a passage 113 of the housing 110. FIG. 9B is an end view of the spring 192. The spring 192 is held in compression within the passage 113, biasing the two balls 30, 40 to move upward and out of the respective passages 113 when a transmission line, e.g., line 310, is pulled from the channel 125 of the ball entry guide 120.

Figure 10B:
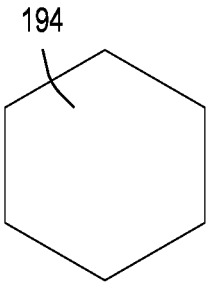
FIG. 10B is a top view of the end cap of FIG. 10A.
Figure 10C:
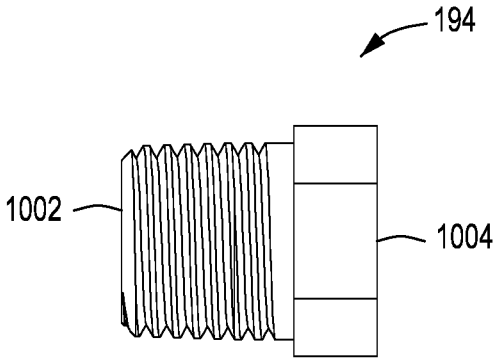
FIG. 10C is a side view of the end cap of FIG. 10A.

Each passage 113 is sealed by an end cap 194. FIG. 10A is a perspective view of an end cap 194 as used to hold the spring 192 of FIG. 9A. FIG. 10B is a top view of the end cap 194 of FIG. 10A while FIG. 10C is a side view.

Each end cap 194 has a proximal end 1002 and a distal end 1004. The proximal end 1002 defines a male threaded end, configured to be screwed into matching threads within a corresponding passage 113. The distal end 1004 is, for example, a hex-head designed to facilitate the screwing in of the end cap 194.

As also noted in connection with FIG. 1A, the enlarged outer diameter portion, or shoulder 117, includes a side opening 119. The side opening 119 receives a set screw 196, followed by a seal screw 198.

Figure 11B:
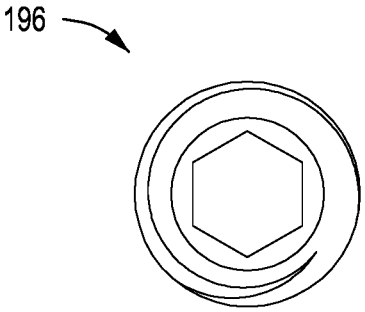
FIG. 11B is a top view of the set screw of FIG. 11A.
Figure 11C:
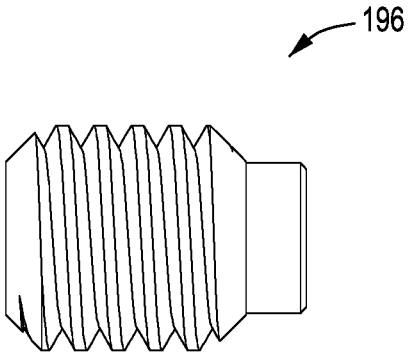
FIG. 11C is a side view of the set screw of FIG. 11A.

FIG. 11A is a perspective view of an alignment set screw 196 as used with the housing 110 of FIG. 1A. FIG. 11B is a top view of the set screw 196, while FIG. 11C is a side view of the set screw 196. As seen in FIGS. 16A and 16B, the set screw 196 is placed through the side opening 119, and then extends into the slot 121 of the ball entry guide 120.

Figure 12B:
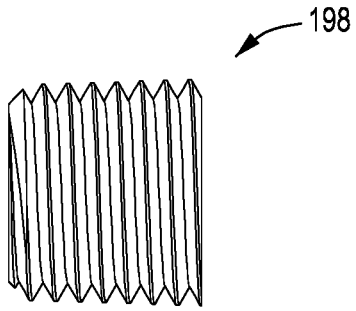
FIG. 12B a side view of the seal screw of FIG. 12A.

FIG. 12A is a perspective view of an NPT seal screw 198 as also used with the housing 110 of FIG. 1A. FIG. 12B a side view of the seal screw 198. The seal screw 198 is designed to facilitate a seal of the side opening 19.

FIG. 13 is a side view of an illustrative sealing ball 30 as may be installed into passages 113 machined into the housing 110 of FIG. 1A. Preferably, the sealing ball 30 is fabricated from a hardened elastomeric material such as neoprene. Of interest, the sealing ball 30 is dimensioned to travel through the passage 113 and then be pushed further into a channel 125 of the ball entry guide 120 when a transmission line is pulled from the central bore 115 of the housing 110. The sealing ball 30 will further fall through a corresponding channel 135 of the ball seat 130. The sealing ball 30 will then land on a corresponding tip 142 of a finger 143 of the packing element 140.

FIG. 14 is a side view of an illustrative locking ball 40 as may also be installed into the passages 113. The locking ball 40 is also fabricated from a hardened elastomeric material such as delprin. The locking ball 40 is dimensioned to fall through the passage 113 and then further into a channel 125 of the ball entry guide 120 when a transmission line is pulled from the central bore 115 of the housing 110. However, the locking ball 40 is dimensioned to land at the top of a corresponding channel 135 of the ball seat 130. Thus, the locking ball 40 will not press on the packing element 140.

It is observed that both the sealing ball 30 and the locking ball 40 are urged down through the passage 113 and into the ball guide 120 in response to the force of a corresponding spring 192. In this way, the cable pack-off apparatus 100 is self-sealing when a transmission line is pulled from the central bore 115 of the housing 110. This could again be following an event of parted tubing.

FIG. 15 is a cut-away view of a tubing head 330 as used to support a production tubing 350 within a wellbore 360. The production tubing 350 serves as a conduit for the production of reservoir fluids, such as hydrocarbon liquids and gases.

The tubing head 330 is designed to reside at a surface. The surface may be a land surface; alternatively, the surface may be an ocean bottom or a lake bottom, or a production platform offshore. The tubing head 330 is designed to be part of a larger well head used to control and direct production fluids and to enable access to the "back side" of the tubing 350.

The tubing head 330 supports a tubing hanger 340. The tubing hanger 340 sits in the tubing head 330 (or tubing spool) locked in place with lock pins 336. The tubing hanger 340 is threadedly connected to a top joint of the production tubing 350. The tubing hanger 340 is lowered into the well using a working joint (or "pup joint") 370.

The tubing head 330 also includes an auxiliary port 342. The auxiliary port 342 receives a bundle of transmission lines 300, such as a power cable 310, that pass through the tubing head 330 en route to the wellbore 360 and then downhole to an electrical device (not shown).

The illustrative tubing head 330 includes a lower flange 332 and an upper flange 334. The lower flange 332 includes a plurality of equi-radially placed through openings 335 that receive large threaded connectors (not shown). This enables the tubing head 330 to be bolted onto a base plate or other portion of a well head.

The upper flange 334 also includes a plurality of equi-radially placed through openings 335 to receive large threaded connectors (not shown). This enables the tubing head 330 to be secured to upper components of a so-called Christmas tree.

FIG. 15 shows a string of production tubing 350 being lowered into the wellbore 360. In FIG. 15, the wellbore 360 is represented by a casing string 360. As each joint of production tubing 350 is lowered into the casing string 360, the transmission lines 300 are banded to the joint, guiding the transmission lines 300 lower into the wellbore. Preferably, the transmission lines 300 are run through the pack-off apparatus 100 and the connected auxiliary port 342, providing for a continuous length of transmission lines 300 from the well head to a power box.

It is understood that the wellbore has been completed by setting a series of pipes into the subsurface. These pipes are referred to as casing, and are typically hung from the well head 330. In some cases, a lowermost string of casing, referred to as production casing 360, is hung from an intermediate string of casing. In this instance, the casing may be referred to as a liner.

FIG. 16A is a first cross-sectional view of the cable pack-off apparatus 100 of FIG. 1. Here, a pair of transmission lines 310, 320 is passing through the pack-off housing 110. One of the transmission lines 310 is intended to illustrate a power cable 310. The power cable 310 extends from the cable pack-off apparatus 100, down through the tubing head 330 of FIG. 15, down into the wellbore 360, and to an electric submersible pump (or other electric device, not shown).

It is noted in FIG. 16A that the presence of the transmission line 310 through the ball entry guide 120 and ball seat 130 prevents the sealing ball 30 from entering the ball entry guide 120 and falling through the ball seat 130. Similarly, the transmission line 310 prevents the locking ball 40 from landing on the ball seat 120. Of interest, the spring 192 remains compressed within the passage 113.

FIG. 16B is a second cross-sectional view of the cable pack-off apparatus 100 of FIG. 1. Here, the illustrative transmission line 310 has broken off, causing the cable pack-off apparatus 100 to self-seal. It can be seen that the sealing ball 30 has passed through the ball entry guide 120 and ball seat 130, and has landed on a finger 143 of the packing element 140. Also, the locking ball 40 has landed on the ball seat 130. This is in response to the energized spring 192.

As noted, the cable pack-off apparatus 100 is designed to be screwed into the auxiliary port 342. Before the installation of the cable pack-off apparatus 100 onto the auxiliary port 342, components of the apparatus 100 are installed within the housing 110. The rectangular slot 121 that runs axially on the outside diameter of the ball guide 120 is lined up with the threaded opening hole 119 on the outer diameter of the housing 110. A set screw 196 is set in the slot 121 of the ball guide 120 to prevent the ball guide 120 from coming out of position within the housing 110. The set screw 196 is backed up with the NPT screw 198 to seal off the threaded hole 119.

During installation, the ball seat 130 is fitted with the alignment pin 180. The alignment pin 180 fits into an opening 127 of the ball entry guide 120, and further fits into an opening 137 of the ball seat 130. When the pin 180 is placed into the adjacent openings 127, 137, this helps to align the ball entry guide 120 with the ball seat 130. An o-ring 170A is installed on the outer diameter of the ball seat 130 to provide a barrier within the central bore 115. With the alignment pin 180 and o-ring 170A in place, the ball seat 130 is ready to be installed within the housing 110.

Sealing off the central bore 115 requires the open-ended plug 160 to be prepared with the spacer 150, the second o-ring 170B, and the elastomeric packing element 140. The open-ended plug 160 has two different threads—one 161 that screws into the central bore 115 and the other 163 that allows the open-ended plug 160 to have piping screwed into the end 164 to have ESP cable 310 routed through the end 164. The spacer 150 and the packing element 140 are installed into the central bore 115 between the open-ended plug 160 and the ball seat 130.

The tubing head 330 receives power wires 310 that pass through the tubing head 330 en route to the wellbore 360 and then downhole to an electrical submersible pump. In one aspect, the packing element 140 is configured to have ESP cable wires 310 pass through three holes 145 to ensure the well bore products don't pass through holes meant for wires. Each of the wires may represent a separate electrical, optical or fluidic conduit, or may represent separate leads and ground for a single electrical cable.

As can be seen, an apparatus 100 is provided that is self-sealing, creating a barrier against the loss of petroleum products, water, and gases that may leak through an auxiliary port located along a tubing hanger. The apparatus 100 may be conveniently screwed into the auxiliary port of the tubing hanger, and utilizes spring-loaded balls that fill the void left behind by pulled or lost wires. It is recommended that an angled coupler be used to angle the apparatus 100 away from the tubing protruding from the top end of the tubing hanger. In either instance, the barrier above the auxiliary port allows the wellbore to remain secure in the case of tubing parting due to tubing defects.

Using the cable pack-off apparatus, a method of sealing a tubing head over a wellbore is also provided herein. In one aspect, the method first comprises identifying a wellbore having a tubing head. The tubing head has a tubing hanger that is connected to a tubing string which extends down into the wellbore. The tubing hanger and connected tubing string are together gravitationally supported by the tubing head.

The method also includes identifying an auxiliary port along the tubing head. The auxiliary port conveys one or more transmission lines from the wellbore and through the tubing head.

Further, the method includes providing a cable pack-off apparatus 100. The cable pack-off apparatus is configured in accordance with any of the embodiments described above.

The method then comprises connecting the cable pack-off apparatus to the auxiliary port along the tubing head. In this way, the at least one transmission line passes from a power distribution box, through the open-ended plug, through the central bore of the cable pack-off apparatus, through the connector, through the auxiliary port in the tubing head, and into the wellbore. In one aspect, connecting the cable pack-off apparatus to the auxiliary port comprises threadedly connecting the pack-off housing to the auxiliary port while permitting the power cable to pass from the auxiliary port, through the pack-off housing, and out through the open-ended plug. In this way, the transmission lines themselves are not twisted during installation.

In a preferred embodiment, the method also includes identifying a condition of parted tubing within the wellbore, shutting off electrical power to the power cable, and pulling the upper severed portion of the power cable from the central bore of the pack-off housing, thereby allowing the at least one sealing ball to fall into the central bore. In this way, the wellbore is sealed to the surface.

While it will be apparent that the inventions herein described are well calculated to achieve the benefits and advantages set forth above, it will be appreciated that the inventions are susceptible to modification, variation and change without departing from the spirit thereof.

What is claimed is:

1. A cable pack-off apparatus for a tubing head, the tubing head having a tubing hanger gravitationally supported by the tubing head and an auxiliary port along the tubing head, the cable pack-off apparatus comprising:

a pack-off housing, the pack-off housing having a tubular body defining a proximal end and a distal end, and a central bore passing through the tubular body from the proximal end to the distal end, and wherein the central bore is configured to receive one or more transmission lines;

an open-ended plug configured to be received within the distal end of the pack-off housing;

a connector at a proximal end of the pack-off housing, the connector being configured to connect the pack-off housing to the auxiliary port while permitting the one or more transmission lines to pass from the auxiliary port, through the connector, and into the pack-off housing;

an elastomeric packing element configured to receive the one or more transmission lines within the central bore, and to seal around the one or more transmission lines individually; and at least one sealing ball configured to fall move into the central bore and to block a corresponding through-opening of the packing element when a transmission line is pulled from the auxiliary port and out of the open-ended plug, wherein:

the one or more transmission lines comprises at least two transmission lines;

one of the at least two transmission lines is a power cable;

the central bore is configured to receive the at least two transmission lines;

the elastomeric packing element comprises at least two fingers extending from a tubular body, wherein each of the at least two fingers comprises a through-opening configured to closely receive a respective transmission line;

the at least one sealing ball comprises at least two sealing balls; and the packing element comprises an elastomeric body having a proximal end and a distal end, with the through-openings extending therethrough.

2. The cable pack-off apparatus of claim 1, wherein the pack-off housing comprises:

a shoulder formed around the tubular body, the shoulder defining an area of enlarged outer diameter of the tubular body; and a sloped surface along the shoulder, the sloped surface comprising two or more passages, wherein each passage receives one of the at least two sealing balls, with the sealing balls being biased to enter the central bore of the pack-off housing from an angle.

3. The cable pack-off apparatus of claim 2, wherein each of the two or more passages receives one of the sealing balls, a biasing spring to bias the one of the sealing balls into the central bore of the pack-off housing, and a threaded end cap.

4. The cable pack-off apparatus of claim 3, further comprising:

a ball entry guide configured to be received within the central bore of the pack-off housing, and having at least two channels, with each channel being configured to receive a respective sealing ball when a corresponding transmission line is removed from the auxiliary port and the central bore of the pack-off housing; and a ball seat having a proximal end and a distal end, and at least two channels extending there through, wherein:

the ball seat lands on the elastomeric body within the central bore of the pack-off housing, and each channel of the ball seat engages a respective finger of the packing element, and aligns with a respective channel of the ball entry guide and a respective through-opening of the packing element.

5. The cable pack-off apparatus of claim 4, wherein:

the open-ended plug is threadedly connected to the distal end of the pack-off housing, thereby holding the ball entry guide, the ball seat and the packing element within the central bore of the pack-off housing in compression; and the end caps hold the springs within respective passages in compression.

6. The cable pack-off apparatus of claim 5, further comprising:

a spacer body having two or more transmission line openings, the spacer body configured to reside within the pack-off housing between the open-ended plug and the packing element; and a first o-ring that resides along an outer diameter of the ball seat; and a second o-ring residing between a body of the open-ended plug and the surrounding central bore.

7. The cable pack-off apparatus of claim 5, wherein:

the at least two transmission lines comprises a data cable, a chemical treatment injection line, or both.

8. The cable pack-off apparatus of claim 5, wherein:

the two or more passages comprise three passages equi-radially spaced about the sloped surface of the shoulder, with each passage sealed by a respective end cap;

the at least two channels of the ball entry guide comprises three channels;

the at least two channels of the ball seat comprises three channels;

the at least two sealing balls comprises three sealing balls; and the at least two fingers of the packing element form three equi-radially spaced fingers.

9. The cable pack-off apparatus of claim 8, wherein:

the proximal end of the pack-off apparatus is threadedly secured to an auxiliary port of the tubing head; and the power cable extends to an electric submersible pump in a wellbore below the tubing head.

10. The cable pack-off apparatus of claim 5, further comprising:

three locking balls; wherein:

each of the locking balls resides within a respective passage in the shoulder of the pack-off housing, between the associated sealing ball and spring; and each of the locking balls has a diameter that is too large to pass through its respective passage when its associated sealing ball falls into the central bore, but which forms a fluid seal within the passage.

11. The cable pack-off apparatus of claim 10, further comprising:

a cotter pin residing within a body of the ball entry guide and a body of the adjacent ball seat, and designed to align the channels of the ball entry guide with the channels of the ball seat.

12. A method of sealing a tubing head over a wellbore, comprising:

identifying a wellbore having a tubing head, with the tubing head having a tubing hanger and connected tubing string extending down into the wellbore gravitationally supported by the tubing head;

identifying an auxiliary port along the tubing head, the auxiliary port conveying one or more transmission lines from the wellbore and through the tubing head;

providing a cable pack-off apparatus, the cable pack-off apparatus comprising:

a pack-off housing, the pack-off housing having a tubular body defining a proximal end and a distal end, and a central bore passing through the tubular body from the proximal end to the distal end, and wherein the central bore is configured to receive the one or more transmission lines;

an open-ended plug configured to be received within the distal end of the pack-off housing; and an elastomeric packing element configured to receive the one or more transmission lines within the central bore, and to seal around the one or more transmission lines individually; and connecting the cable pack-off apparatus to the auxiliary port along the tubing head, such that the one or more transmission lines pass from the wellbore, through the auxiliary port, and through the open-ended plug, wherein:

the cable pack-off apparatus further comprises a connector at a proximal end of the pack-off housing;

connecting the cable pack-off apparatus to the auxiliary port comprises threadedly connecting the pack-off housing to the auxiliary port while permitting the one or more transmission lines to pass from the auxiliary port, through the connector, through the pack-off housing, and out through the connector; and the cable pack-off apparatus further comprises at least one sealing ball configured to move into the central bore and to block a corresponding through-opening of the packing element when one of the one or more transmission lines is pulled from the auxiliary port and the central bore of the pack-off housing.

13. The method of claim 12, wherein:

the one or more transmission lines comprises a power cable; an electrical downhole tool resides within the tubing string; and the power cable is in electrical communication with the electrical downhole tool within the wellbore.

14. The method of claim 13, further comprising: electrically connecting the power cable to a power source.

15. The method of claim 12, further comprising:

identifying a condition of parted tubing within the wellbore, wherein at least one of the one or more transmission lines is severed; and pulling the at least one severed transmission line from the central bore of the pack-off housing, thereby allowing the one or more sealing balls to fall into the central bore where the at least one severed transmission line was.

16. The method of claim 12, wherein:

the one or more transmission lines comprises at least two transmission lines;

one of the at least two transmission lines is a power cable;

the central bore is configured to receive the at least two transmission lines;

the elastomeric packing element comprises at least two fingers extending from a tubular body, wherein each of the at least two fingers comprises a through-opening configured to closely receive a respective transmission line; and the at least one sealing ball comprises at least two sealing balls; and the packing element comprises an elastomeric body having a proximal end and a distal end, with through-openings extending therethrough aligned with the through-opening of the fingers.

17. The method of claim 16, wherein the pack-off housing comprises:

a shoulder formed around the tubular body, the shoulder defining an area of enlarged outer diameter of the tubular body; and a sloped surface along the shoulder, the sloped surface comprising two or more passages, wherein each passage receives one of the at least two sealing balls, with the sealing balls being biased to enter the central bore of the pack-off housing from an angle.

18. The method of claim 17, wherein each of the two or more passages receives one of the sealing balls, a biasing spring to bias the one of the sealing balls into the central bore of the pack-off housing, and a threaded end cap.

19. The method of claim 18, further comprising:

a ball entry guide configured to be received within the central bore of the pack-off housing, and having at least two channels, with each channel being configured to receive a respective sealing ball when a corresponding transmission line is removed from the auxiliary port and the central bore of the pack-off housing; and a ball seat having a proximal end and a distal end, and at least two channels extending there through, wherein:

the ball seat lands on the elastomeric body within the central bore of the pack-off housing, and each channel of the ball seat engages a respective finger of the packing element, and aligns with a respective channel of the ball entry guide and a respective through-opening of the packing element.

20. The method of claim 19, wherein:

the open-ended plug is threadedly connected to the distal end of the pack-off housing, thereby holding the ball entry guide, the ball seat and the packing element within the central bore of the pack-off housing in compression; and the threaded end caps hold the springs within respective passages in compression.

21. The method of claim 20, wherein the cable pack-off apparatus further comprises:

a spacer body having two or more transmission line openings, the spacer body configured to reside within the pack-off housing between the open-ended plug and the packing element;

a first o-ring that resides along an outer diameter of the ball seat; and a second o-ring residing between a body of the open-ended plug and the surrounding central bore.

22. The method of claim 21, wherein:

the at least two transmission lines comprises a data cable, a chemical treatment injection line, or both.

23. The method of claim 20, wherein:

the two or more passages comprise three passages equi-radially spaced about the sloped surface of the shoulder;

the at least two channels of the ball entry guide comprises three channels;

the at least two channels of the ball seat comprises three channels;

the at least two sealing balls comprises three sealing balls; and the at least two fingers of the packing element form three equi-radially spaced fingers.

24. The method of claim 23, wherein:

the proximal end of the pack-off apparatus is threadedly secured to an auxiliary port of the tubing head; and the power cable extends to an electric submersible pump in a wellbore below the tubing head.

25. The method of claim 20, wherein the cable pack-off apparatus further comprises: three locking balls; wherein:

each of the locking balls resides within a respective passage in the shoulder of the pack-off housing, between the associated sealing ball and spring; and each of the locking balls has a diameter that is too large to pass through its respective passage when its associated sealing ball falls into the central bore, but which forms a fluid seal within the passage.

26. The method of claim 25, wherein the cable pack-off apparatus further comprises a cotter pin residing within a body of the ball entry guide and a body of the adjacent ball seat, and designed to align the channels of the ball entry guide with the channels of the ball seat.

27. A method of sealing a tubing head over a wellbore, comprising:

identifying a wellbore having a tubing head, with the tubing head having a tubing hanger and connected tubing string extending down into the wellbore gravitationally supported by the tubing head, and with the tubing head further having an auxiliary port through which a power cable is carried, the power cable extending from the auxiliary port, down through the tubing head, into the wellbore, and down to a downhole electrical device;

determining that the wellbore has a condition of parted tubing, resulting in a severance of the power cable; and pulling the severed power cable from the wellbore, through the auxiliary port, and through a cable pack-off apparatus positioned above the auxiliary port, wherein the cable pack-off apparatus self-seals the tubing head upon removal of the power cable from the tubing head.

28. The method of claim 27, wherein:

the downhole electrical device is an electric submersible pump; and the method further comprises shutting off electrical power to the power cable before pulling the power cable from the cable pack-off apparatus.

29. A cable pack-off apparatus for a tubing head, comprising:

a housing configured to be received into a port in the tubing head, the housing comprising a bore therethrough and a plurality of passages extending at least partially radially from the bore, the bore being configured to receive a plurality of transmission lines therethrough;

a packing element defining a plurality of through-holes each configured to receive and seal with a separate transmission line of the plurality of transmission lines; and a plurality of sealing members each positioned in one of the plurality of passages, wherein the plurality of transmission lines extending through the bore prevent the plurality of sealing members from being received into the bore, and wherein one of the plurality of transmission lines being removed from one of the plurality of through-holes permits one of the plurality of sealing members to be forced out of one of the plurality of passages and into the bore and to block the one of the plurality of through-holes of the packing element.

30. The cable pack-off apparatus of claim 29, further comprising a plurality of biasing members each positioned in one of the plurality of passages of the housing and configured to bias the sealing members toward the bore.

31. The cable pack-off apparatus of claim 29, wherein the packing element comprises a plurality of axially-extending fingers, each of the fingers defining at least a portion of each of the through-holes, and wherein each of the fingers are configured to seal with one of the sealing members.

32. The cable pack-off apparatus of claim 29, further comprising:

a ball seat positioned in the bore and comprising a plurality of channels each in communication with one of the through-holes of the packing element and configured to receive one of the transmission lines therein; and a plurality of locking balls each positioned in one of the plurality of passages, wherein the locking balls are each configured to seal with one of the channels in the ball seat in response to the one of the transmission lines extending through the one of the channels being removed, and wherein each of the plurality of sealing members is configured to pass through one of the channels in response to the one of the transmission lines extending through the one of the channels being removed.

33. The cable pack-off apparatus of claim 32, wherein the packing element comprises a plurality of axially-extending fingers defining at least a portion of the through-holes, and wherein the ball seat is axially adjacent to the packing element and is configured to receive the axially-extending fingers of the packing element into the channels of the ball seat.

34. The cable pack-off apparatus of claim 29, further comprising a ball entry guide positioned in the bore and defining through-openings through which the transmission lines are separately received, the ball entry guide further defining radially-oriented openings each extending from one of the through-openings and configured to align with one of the passages in the housing, so as to direct one of the sealing members axially toward the packing element when one of the transmission lines is removed.

* * * * *